US008876475B1

(12) United States Patent
Liang

(10) Patent No.: US 8,876,475 B1
(45) Date of Patent: Nov. 4, 2014

(54) TURBINE BLADE WITH RADIAL COOLING PASSAGE HAVING CONTINUOUS DISCRETE TURBULENCE AIR MIXERS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 385 days.

(21) Appl. No.: 13/458,342

(22) Filed: Apr. 27, 2012

(51) Int. Cl.
*F01D 5/08* (2006.01)

(52) U.S. Cl.
USPC ..... 416/97 R

(58) Field of Classification Search
CPC ..... F05D 2260/221; F05D 2260/2212; F05D 2260/2214; F05D 2260/22141; F01D 5/18; F01D 5/181; F01D 5/187
USPC ..... 416/97 R, 95, 96 R; 415/115
See application file for complete search history.

(56) References Cited

U.S. PATENT DOCUMENTS

| | | | | |
|---|---|---|---|---|
| 5,472,316 | A * | 12/1995 | Taslim et al. | 416/97 R |
| 5,695,320 | A * | 12/1997 | Kercher | 416/97 R |
| 6,331,098 | B1 * | 12/2001 | Lee | 416/97 R |
| 6,582,584 | B2 * | 6/2003 | Lee et al. | 205/660 |
| 8,096,766 | B1 * | 1/2012 | Downs | 416/96 R |

* cited by examiner

*Primary Examiner* — Edward Look
*Assistant Examiner* — Michael Sehn
(74) *Attorney, Agent, or Firm* — John Ryznic

(57) ABSTRACT

A large span industrial engine turbine rotor blade with a radial extending cooling air passage having a series of turbulence air mixers along the passage, where the turbulence mixers each have an inlet end and a curved and tapered surface such that cooling air is drawn into the inlet end of the mixer and then discharged from the curved and tapered surface into a middle of the passage. The cooling air flows through the passage along a series of these turbulence mixers from one mixer to another mixer along the spanwise length of the passage.

11 Claims, 5 Drawing Sheets

Line A-A

TURBINE BLADE WITH RADIAL COOLING PASSAGE HAVING CONTINUOUS DISCRETE TURBULENCE AIR MIXERS

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to a large span air cooled turbine rotor blade for an industrial gas turbine engine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Latter stages of turbine blades do not require film cooling air, but do require internal convection cooling in order to control the metal temperature to within acceptable levels in order to provide for a long service life. FIG. 1 shows one such prior art turbine blade with radial cooling passages from the root to the blade tip in which convectional cooling occurs. The FIG. 1 blade includes three radial cooling channels 11-13 each having skewed trip strips or turbulators formed along the walls that function to enhance the heat transfer efficiency of the cooling channel. FIG. 2 shows a cross section top view of the blade of FIG. 1 with the radial cooling channels and trip strips along the walls.

In the radial cooling channels with trip strips of FIGS. 1 and 2, as the cooling air flows through the skewed trip strips, the leading edge of the trip strip trips the thermal boundary layer of the cooling air which results in a higher local heat transfer coefficient and thus an increase in the airfoil cooling performance. A normal flow of cooling air over a flat surface would produce a boundary layer between the flat surface and the moving cooling air flow. The boundary layer acts as a baffle zone. Tripping the boundary layer using the trip strips increases the heat transfer rate. FIG. 3 shows the prior art skewed trip strips along the radial passage with the leading edge at a lower spanwise height than the trailing edge of the same trip strip. FIG. 4 shows a cross section view through one of the trip strips in FIG. 3 along the line A-A with the cooling air flow paths over the trip strips. A result of this boundary layer tripping is that vortices are generated and propagate along the trip strips from the leading edge to the trailing edge. As these vortices propagate along the full length of the trip strip, the boundary layer becomes progressively more disturbed or thick, and therefore the tripping of the boundary layer becomes progressively less effective. The result of this boundary layer growth is a significantly reduced heat transfer effect. Also, for a large channel height cooling air passage typical for latter stage industrial engine turbine blades, the vortex occurs near the inner wall of the airfoil. A majority of the cooling air flow still remains in the middle of the radial passage away from the hot wall surface that requires the convection cooling.

BRIEF SUMMARY OF THE INVENTION

A large span industrial engine turbine rotor blade with a radial extending cooling air passage having a series of turbulence air mixers along the walls of the passage. Each turbulence mixer is formed with an inlet end and a curved and tapered surface such that cooling air is drawn into the inlet end and discharged from the curved and tapered surface towards a middle of the passage.

In a radial passage having four walls, a series of four turbulence mixers are arranged such that the mixer above will be drawn in the cooling air discharged from the mixer below and discharge the cooling air into the middle of the passage, where the mixer above will then draw in the cooling air from the middle of the passage and discharge the cooling air into the middle of the passage so that the next above mixer will be drawn in the cooling air. The turbulence mixers drawn in the cooling air to flow along the hot wall surfaces of the passage and then discharge the hotter cooling air into the middle of the passage to mix with the cooler cooling air such that the overall convection cooling effectiveness is increased.

DETAILED DESCRIPTION OF THE INVENTION

The present invention is a turbine rotor blade with a long span height such as a later stage turbine blade in an industrial gas turbine engine. These long span blades have radial cooling passages from the root to the blade tip with a large cross section flow area because of the size of the airfoil. The cooling air would require a high velocity in order to produce a high rate of cooling for these larger blades. However, the use of a large amount of cooling air required to produce a high velocity would be very inefficient because the cooling air is supplied from a compressor of the engine. In order to allow for a low flow cooling rate, the present invention uses a series of discrete but continuous turbulence air mixers within the radial cooling channel to mix the cooling air flow and force the cooling air along the walls with the aid of the centrifugal forces developed due to the rotation of the blade.

Figure 1:
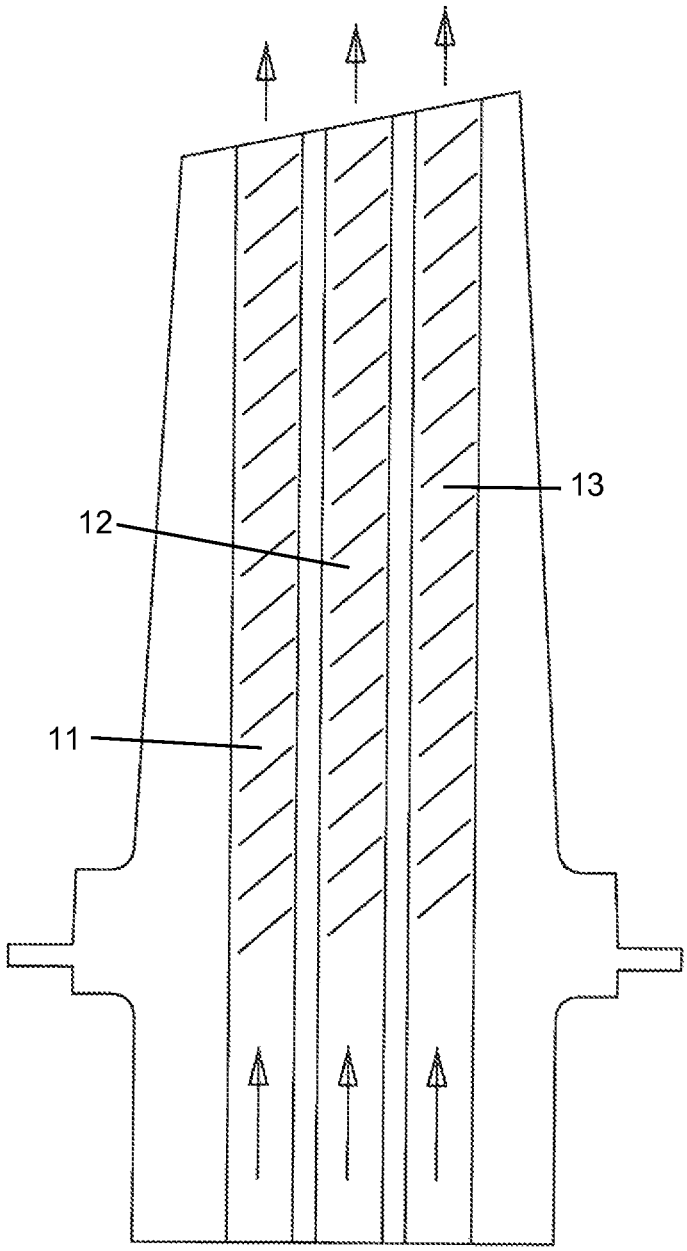
FIG 1 Prior Art
FIG. 1 shows a turbine rotor blade of the prior art with radial cooling passages using skewed trip strips.
Figure 2:
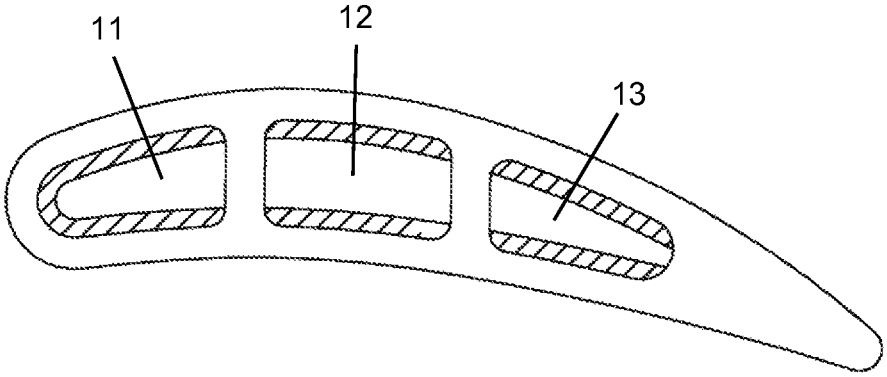
FIG 2 Prior Art
FIG. 2 shows a cross section top view of the FIG. 1 turbine blade with the radial cooling passages and trip strips.
Figure 3:
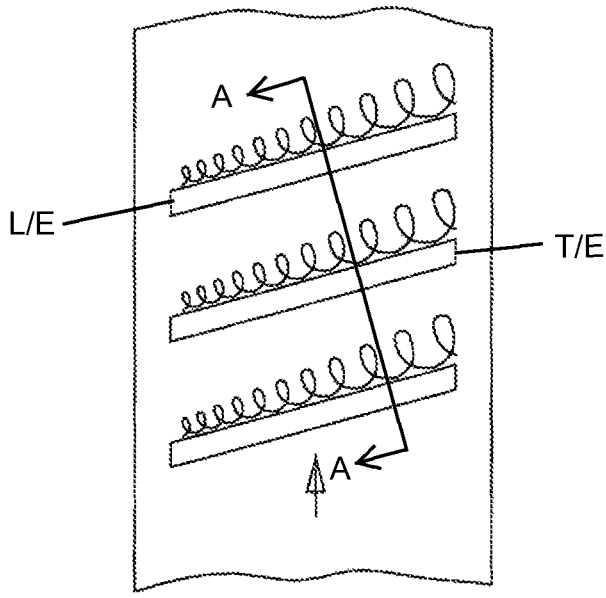
FIG 3 Prior Art
FIG. 3 shows a side view of a radial cooling passage in the FIG. 1 blade with several of the skewed trip strips.
Figure 4:
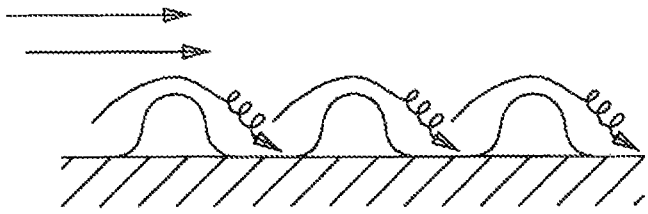
FIG 4 Prior Art
FIG. 4 shows a cross section view of the trip strips in FIG. 3 through the line A-A.
Figure 5:
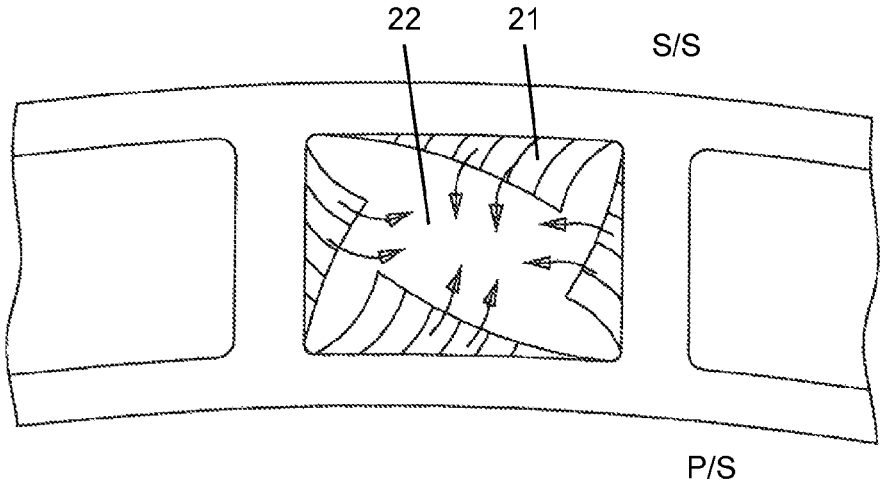
FIG. 5 shows a top view of a radial extending cooling air channel with four of the turbulence air mixers of the present invention.
Figure 6:
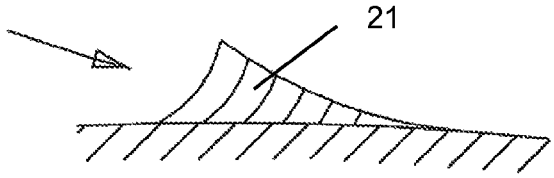
FIG. 6 shows a side view of one of the turbulence air mixers of the present invention.

FIG. 5 shows a section of a blade with a pressure side (P/S) wall and a suction side (S/S) wall with three radial channels 22 formed between the two walls. The walls are rectangular in shape and formed by four substantially straight surfaces. Each of the four walls that form the radial passage has a series of the turbulence air mixers 21 that form the present invention. Each turbulence air mixer 21 has a flow-in or inlet end as seen in FIG. 6 with a skewed (offset angle to a chordwise plane of the blade) and tapered and curved surface that merges into the passage wall at an opposite end from the flow-in or inlet end. The curved and tapered surface forces the cooling air toward the middle of the radial channel as seen by the arrows in FIG. 5. The turbulence mixers 21 are at a skewed angle to the wall surfaces.

Figure 7:
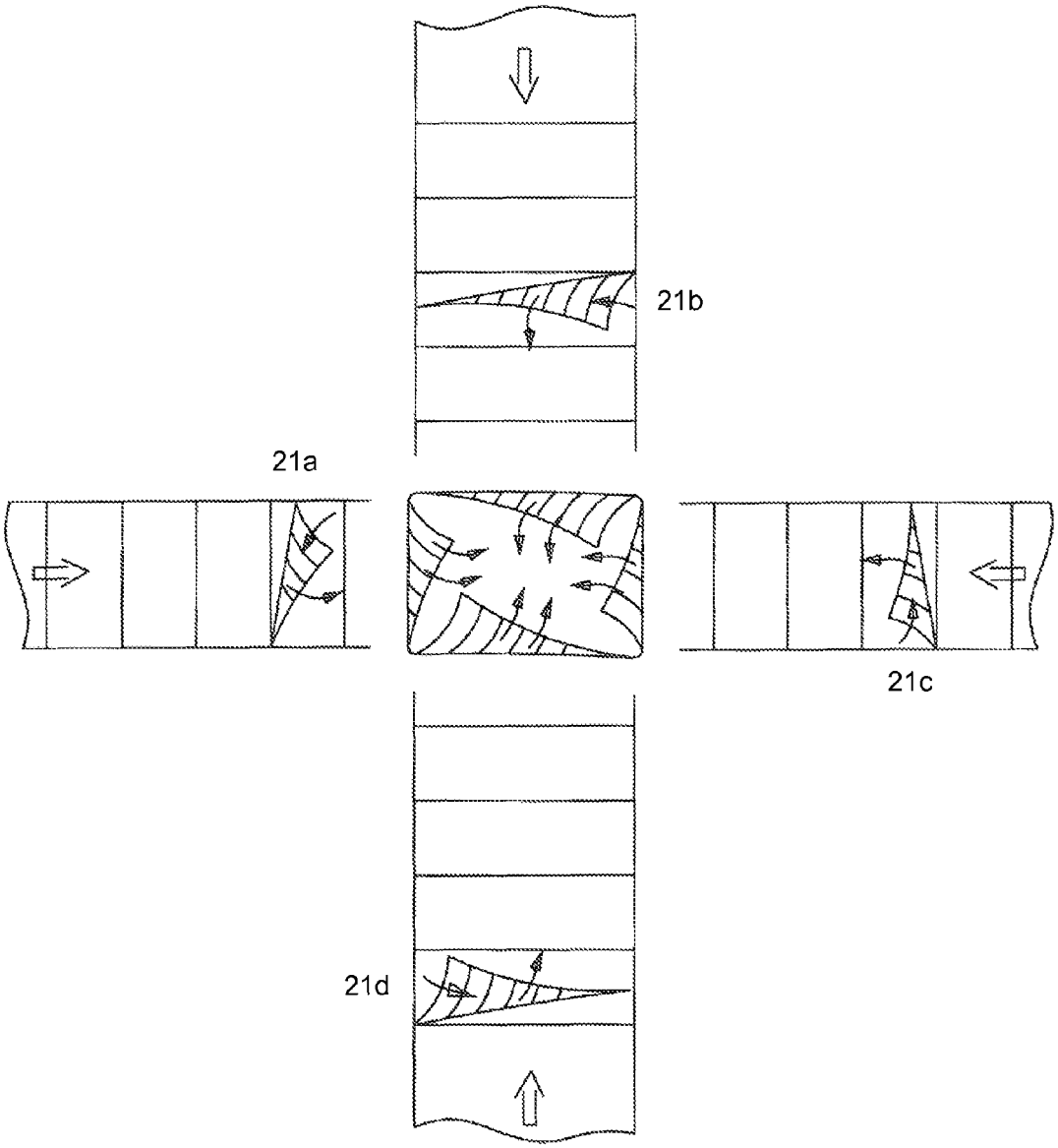
FIG. 7 shows top views of each of the four side walls in a radial extending cooling air channel with the arrangement of turbulence air mixers of the present invention.

The turbulence air mixers 21 are arranged as shown in FIG. 7 where a first turbulence mixer 21*d* is on a first of the four wall surfaces, a second turbulence mixer 21*c* is located above the first turbulence mixer 21*d* on an adjacent wall surface, a third turbulence mixer 21*b* is located above the second turbulence mixer 21*c* on a wall adjacent to the second turbulence mixer 21*c*, and the fourth turbulence mixer 21*a* is located above the third turbulence mixer 21*b* adjacent to the walls of the first and third turbulence mixers 21*d* and 21*b*. This series of 21*a* and 21*b* and 21*c* and 21*d* is repeated along the length of the radial cooling channel and form a spiral shaped arrangement along the radial extending passage.

In operation, the cooling air flows through the radial cooling channel from the lower span toward the blade tip. The cooling air is captured at the leading edge of the first turbulence air mixer 21*d* which forces the cooling air to flow toward the middle of the radial passage 22. The cooling air is then captured by the next turbulence mixer 21*c* directly above the first turbulence mixer 21*d*. The second turbulence mixer 21*c* will draw the cooling air in from the inlet end and force the cooling air out into the middle of the radial passage 22. This is repeated in the series of turbulence mixers until the cooling air is discharged through the blade tip. This process of drawing in the cooling air into the turbulence mixer 21 and then forcing the cooling air into the middle of the radial passage 22 creates a vortex flow within the passage 22 that mixes the cooling air along the spanwise length of the cooling air passage 22. The mixed and swirling cooling air flows outward through the radial cooling passage 22 and creates a higher pressure and a higher velocity at the outer periphery with a continuous mixture of the cooler air flowing in the middle of the radial passage 22. Thus, the hotter cooling air forced out from the wall surfaces will be mixed with the cooler cooling air flowing through the middle of the radial passage. The higher velocity cooling air at the outer periphery of the cooling air radial passage generates a higher rate of internal heat transfer coefficient and thus provides for a higher cooling effectiveness for the radial cooling air passage with a more uniform mixture of the cooling air.

Because the turbulence mixers 21 of the present invention are formed with a curved and tapered geometry around the radial cooling passage, the continuous and discrete turbulence air mixers cannot be formed by the prior art investment casting process which uses a ceramic core to form the passages and turbulators. However, the turbulence air mixers 21 of the present invention can be easily formed using a metal printing process that can form the blade and the turbulence mixers as a single piece from one or more materials. Such a metal printing process was developed by Mikro Systems, Inc. from Charlottesville, Va. In the metal printing process, the blade and its cooling air features and details are all formed by gradually printing the blade in layers from bottom to top using a laser sintering process or something like it. The blade with the turbulence air mixers of the present invention can create a high velocity with the mixed cool air at the inner wall of the passage, and thus generate a high rate of internal convection heat transfer coefficient and an improvement in overall cooling performance. This results in a reduction in the cooling flow demand an therefore an increase in the gas turbine engine efficiency.

I claim the following:

1. An industrial engine turbine rotor blade comprising:
- a pressure side wall and a suction side wall;
- a radial extending cooling air passage formed between the pressure side wall and the suction side wall;
- a series of turbulence air mixers extending along the radial extending cooling air passage;
- each turbulence air mixer having an inlet end and a tapered and curved surface such that cooling air is drawn into the turbulence air mixer at the inlet end and discharged from the tapered and curved surface toward a middle of the radial extending cooling air passage;
- the series of turbulence air mixers are staggered in the radial direction of the cooling air passage; and,
- each turbulence air mixer is a curved triangle shape.

2. The industrial engine turbine rotor blade of claim 1, and further comprising:
- each turbulence air mixer tapers down to the wall of the passage on the end opposite from the inlet end.

3. The industrial engine turbine rotor blade of claim 1, and further comprising:
- each turbulence air mixer is also skewed.

4. The industrial engine turbine rotor blade of claim 1, and further comprising:
- each turbulence air mixer extends across substantially the entire wall surface of the radial extending cooling air passage.

5. The industrial engine turbine rotor blade of claim 1, and further comprising:
- an inlet end of the turbulence mixer extends into the radial extending cooling air passage and an outlet end that is flush with a surface of the radial extending cooling air passage.

6. An industrial engine turbine rotor blade comprising:
- a pressure side wall and a suction side wall;
- a radial extending cooling air passage formed between the pressure side wall and the suction side wall;
- a series of turbulence air mixers extending along the radial extending cooling air passage;
- each turbulence air mixer having an inlet end and a tapered and curved surface such that cooling air is drawn into the turbulence air mixer at the inlet end and discharged from the tapered and curved surface toward a middle of the radial extending cooling air passage;
- the series of turbulence air mixers are staggered in the radial direction of the cooling air passage;
- the radial extending cooling air passage is formed by four walls; and,
- the series of turbulence air mixers are formed with a first turbulence air mixer of a first wall, a second turbulence air mixer on a second wall just above the first turbulence air mixture, a third turbulence air mixer on a third wall just above the second turbulence mixer, and a forth turbulence air mixer on a fourth wall just above the third turbulence air mixer.

7. A method for manufacturing a large span industrial engine turbine rotor blade having a radial extending cooling air passage comprising the steps of:

forming the turbine rotor blade with a radial cooling air passage by printing the blade using a metal printing process;

forming a plurality of turbulence mixers along surfaces of the radial extending cooling air passage by the metal printing process in which the turbulence mixers each have an inlet end and a tapered and curved surface such that cooling air is drawn into the turbulence air mixer at the inlet end and discharged from the tapered and curved surface toward a middle of the radial extending cooling air passage;

forming the radial extending cooling air passage with four side walls; and, forming an alternating series of turbulence mixers on the four walls in a spiral arrangement.

8. The method for manufacturing a large span industrial engine turbine rotor blade of claim 7, and further comprising the steps of:

printing each of the turbulence mixers with a skewed orientation.

9. An air cooled turbine rotor blade comprising:

a radial extending cooling air channel formed in the airfoil;

a turbulence air mixer extending from a surface of the radial extending cooling air channel;

the turbulence air mixer being triangular in shape and with a curved surface such that cooling air flowing along the surface will be discharged toward a middle of the radial extending cooling air passage.

10. The air cooled turbine rotor blade of claim 9, and further comprising:

a longer side of the triangular shaped mixer is on the surface of the radial extending cooling air channel.

11. The air cooled turbine rotor blade of claim 10, and further comprising:

an inlet end of the turbulence air mixer is formed by a shorter side of the triangular shaped mixer; and, an outlet end of the turbulence air mixer is flush with the surface of the radial extending cooling air channel.

* * * * *